US010815629B2

(12) United States Patent
Goedken et al.

(10) Patent No.: US 10,815,629 B2
(45) Date of Patent: Oct. 27, 2020

(54) GARBAGE TRUCK SWEEPER ATTACHMENT

(71) Applicant: Kann Manufacturing Corporation, Guttenberg, IA (US)

(72) Inventors: Kenneth D. Goedken, Dubuque, IA (US); Jared Rowland, Dyersville, IA (US); Marlin L. Johnson, Guttenberg, IA (US)

(73) Assignee: Kann Manufacturing Corporation, Guttenberg, IA (US)

( * ) Notice: Subject to any disclaimer, the term of this patent is extended or adjusted under 35 U.S.C. 154(b) by 0 days.

(21) Appl. No.: 15/200,750

(22) Filed: Jul. 1, 2016

(65) Prior Publication Data

US 2017/0002530 A1 Jan. 5, 2017

Related U.S. Application Data

(60) Provisional application No. 62/188,265, filed on Jul. 2, 2015, provisional application No. 62/187,490, filed on Jul. 1, 2015.

(51) Int. Cl.

| | |
|---|---|
| ***E01H 1/08*** | (2006.01) |
| ***E01H 1/04*** | (2006.01) |
| ***B65F 3/14*** | (2006.01) |
| ***B65F 3/24*** | (2006.01) |

(52) U.S. Cl.

CPC ..... *E01H 1/0845* (2013.01); *B65F 3/14* (2013.01); *B65F 3/24* (2013.01); *E01H 1/04* (2013.01); *E01H 1/047* (2013.01); *E01H 1/042* (2013.01); *E01H 1/0818* (2013.01); *E01H 1/0854* (2013.01)

(58) Field of Classification Search

CPC ... E01H 1/0818; E01H 1/0854; E01H 1/0845; E01H 1/042; E01H 1/045; E01H 1/08; E01H 1/047; E01H 1/04; B65F 3/14; B65F 3/24

USPC ..... 15/340.1, 83, 84, 85, 86, 87, 340.3, 15/340.4, 347, 348, 349, 352

See application file for complete search history.

(56) References Cited

U.S. PATENT DOCUMENTS

| | | | | |
|---|---|---|---|---|
| 4,069,929 | A * | 1/1978 | Harker | B65F 3/14 100/156 |
| 5,361,441 | A * | 11/1994 | Williamson | E01H 1/042 15/83 |
| 5,377,382 | A * | 1/1995 | Bores | A47L 11/4044 15/245 |
| 6,195,836 | B1 * | 3/2001 | Vanderlinden | A47L 11/24 15/340.3 |
| 9,121,150 | B2 * | 9/2015 | Bauer | E01H 1/042 |
| 2013/0322994 | A1 * | 12/2013 | Curotto | B65F 1/122 414/293 |

* cited by examiner

*Primary Examiner* — Mark Spisich
*Assistant Examiner* — Katina N. Henson
(74) *Attorney, Agent, or Firm* — Shuttleworth & Ingersoll, PLC; Brett Papendick

(57) ABSTRACT

A sweeper attachment for a refuse collection vehicle that utilizes either a conveyor system or a vacuum system to transport debris from a road surface to a collection body of the refuse collection vehicle. The sweeper attachment allows for the same vehicle to be used for both refuse collection and sweeping roadway surfaces.

16 Claims, 13 Drawing Sheets

GARBAGE TRUCK SWEEPER ATTACHMENT

CROSS-REFERENCE TO RELATED APPLICATIONS

The present application claims priority to provisional patent application 62/187,490 which was filed on Jul. 1, 2015; and priority to provisional patent application 62/188,265 which was filed on Jul. 2, 2015, and both are hereby expressly incorporated by reference in their entireties.

BACKGROUND OF THE INVENTION

Due in part to the costs associated with both garbage trucks/vehicles and street sweepers, combining the functions of both would save a substantial amount of money for city and county governments and private companies in the maintenance of roads and garbage collection.

It is an object of the invention to provide an attachment that can be selectively attached and removed from a variety of garbage vehicles.

It is further an object of the invention to provide an attachment that does not prohibit the use of a garbage vehicle as a refuse collection vehicle.

SUMMARY OF THE INVENTION

Four embodiments of a sweeper attachment for refuse collecting vehicles are shown in the accompanying figures. Each embodiment allows a typical refuse collection vehicle that can only collect refuse/recyclables into a vehicle that can additionally sweep roadways and collect debris off the roadways.

The embodiments also contain a means for directing the debris from the roadway into the storage compartment of the refuse collecting vehicles. The embodiments use either a conveyor system and/or a vacuum system in conjunction with a set of brooms for directing the debris from the roadway to the storage compartment.

Two of the embodiments are mountable on a standard rear loading refuse collection vehicle. These embodiments do not impair the function of the tailgate of the refuse collection vehicle, and the sweeper attachment is raised and lowered with the tailgate. This allows the debris collected from the sweeper attachment and stored in the collection body of the refuse collection vehicle to be emptied utilizing the same mechanics as for emptying the refuse.

The third embodiment is for a front loading refuse collection vehicle and utilizes a conveyor system. The debris from the street is collecting in a carry can and then dumped by raising and inverting the carry can, thereby dumping the debris into a storage compartment of the front loading refuse collection vehicle.

The fourth embodiment can be used for any type of refuse collection vehicle and utilizes a vacuum for transporting street debris in to a collection container. A series of hydraulic powered scissor hoist to pivot and unload the debris from the collection container to the storage compartment of the refuse collection vehicle.

DETAILED DESCRIPTION

Figure 1:
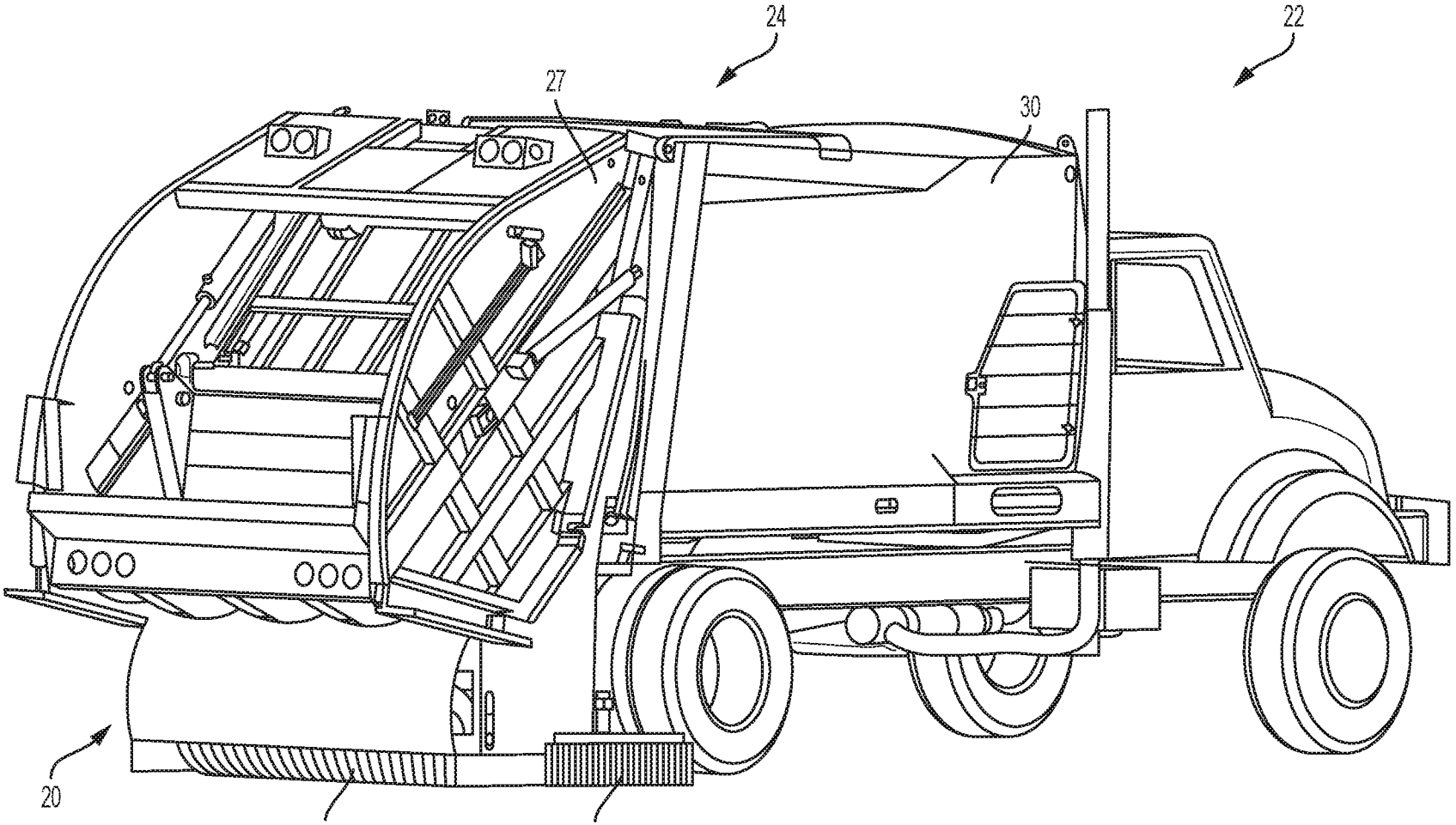
FIG. 1 is a perspective view of a first embodiment on a sweeper attachment on a rear end loader with a conveyor system to move debris from a street surface to a storage area of the rear end loader.
Figure 2:
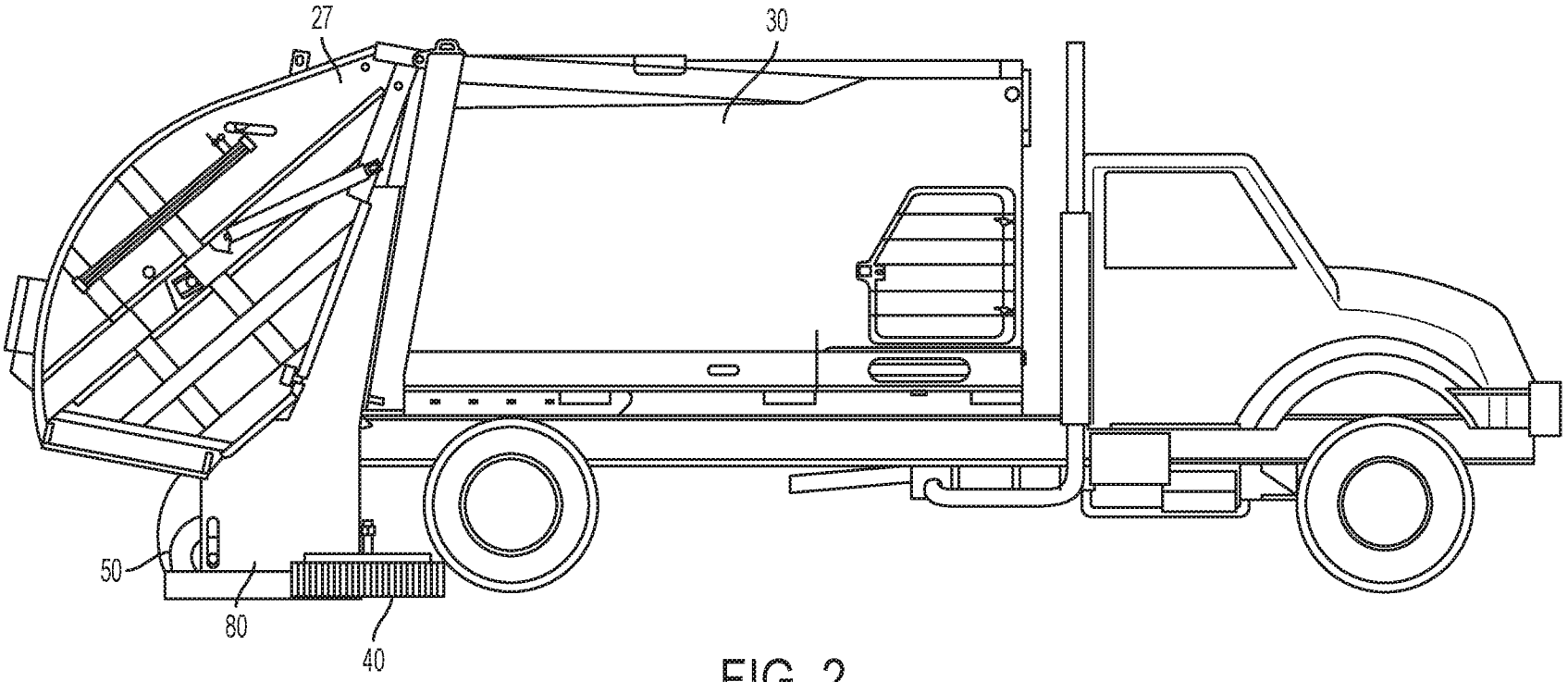
FIG. 2 is a side view of the first embodiment of the sweeper attachment on the rear end loader.
Figure 3:
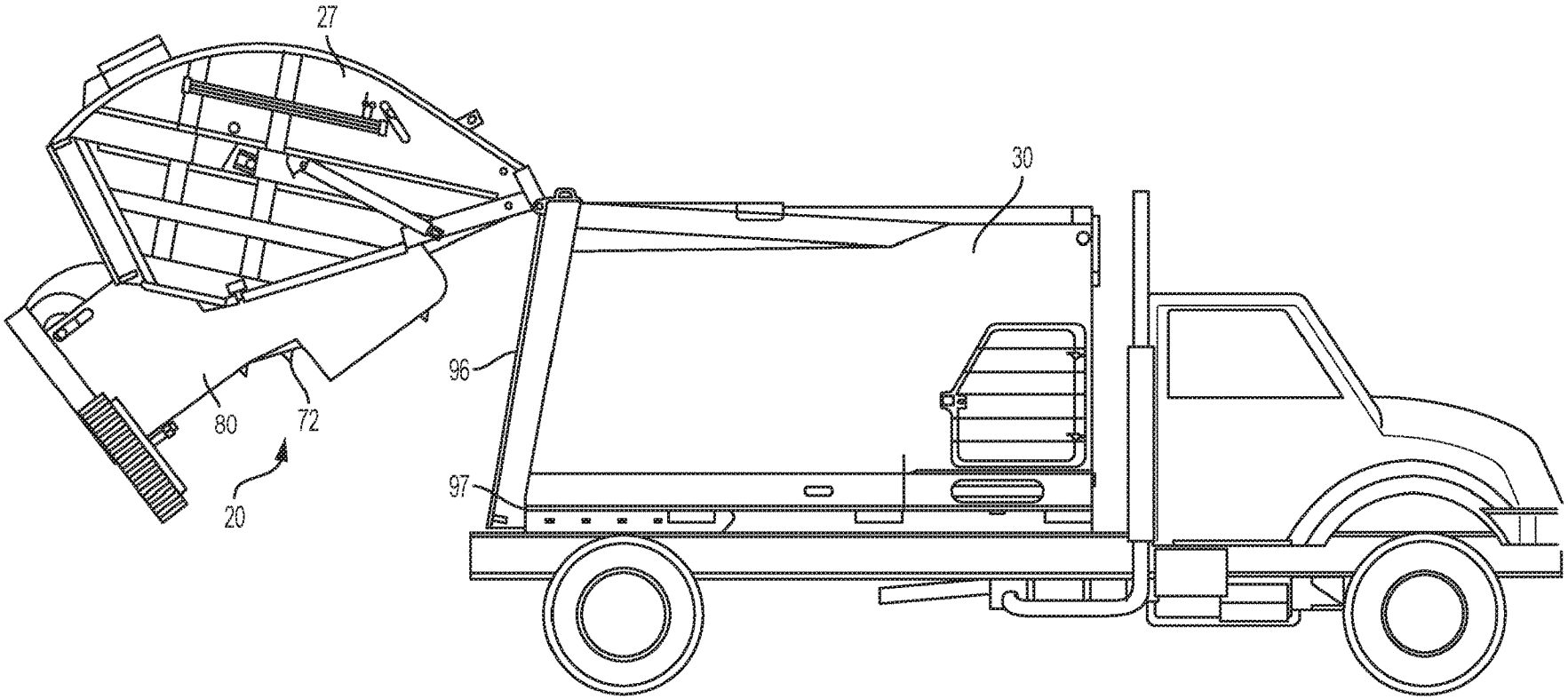
FIG. 3 is a side view of the first embodiment of the sweeper attachment on the rear end loader wherein a tailgate is in an open position.

Now referring to the figures, four embodiments for a sweeper attachment 20 are shown. The first embodiment is shown in FIGS. 1-6 and can be used on a standard rear loader garbage vehicle 22. The first embodiment is a conveyor style sweeper system 24 that has the sweeper attachment 20 for street sweeping that is secured to an inside 26 of the rear load tailgate 27 allowing the sweeper attachment 20 to be opened and closed with the normal operation of the rear load tailgate 27 for the loading and normal unloading of the debris commodity. With the tailgate 27 in a closed position, the sweeper attachment 20 fits snugly between the tailgate 27 and a collection body 30 of the rear loader garbage vehicle 22.

The sweeper attachment 20 comprises a main body 80. The main body 80 has a first deflector panel 82 and second deflector panels 84 to assist in deflecting debris and assist in directing the debris toward the conveyor 70 and ultimately to the collection body 30. Additionally, main body 80 has side walls 86 that also assist in directing debris toward the top of the sweeper attachment 20 and also prevents debris from falling off the edge of the cleats 72. A lip 88 of the main body 80 fits snugly with a floor of the collection body 30.

During normal operation, a forward positioned side broom 40 rotates, preferably counterclockwise, sweeping street debris away from the curb towards a main broom 50 of the sweeper attachment 20. This debris along with all other street debris that is in the path of the counterclockwise rotating main broom 50 is mechanically swept up onto a conveyor 70, elevating the debris up and over a top 90 of a conveyor wall insert 91 into the collection body 30. The conveyor 70 preferably has cleats 72 that aid in moving the debris and prevent the debris from falling prior to reaching the top 90 of the conveyor wall insert 91.

Figure 4:
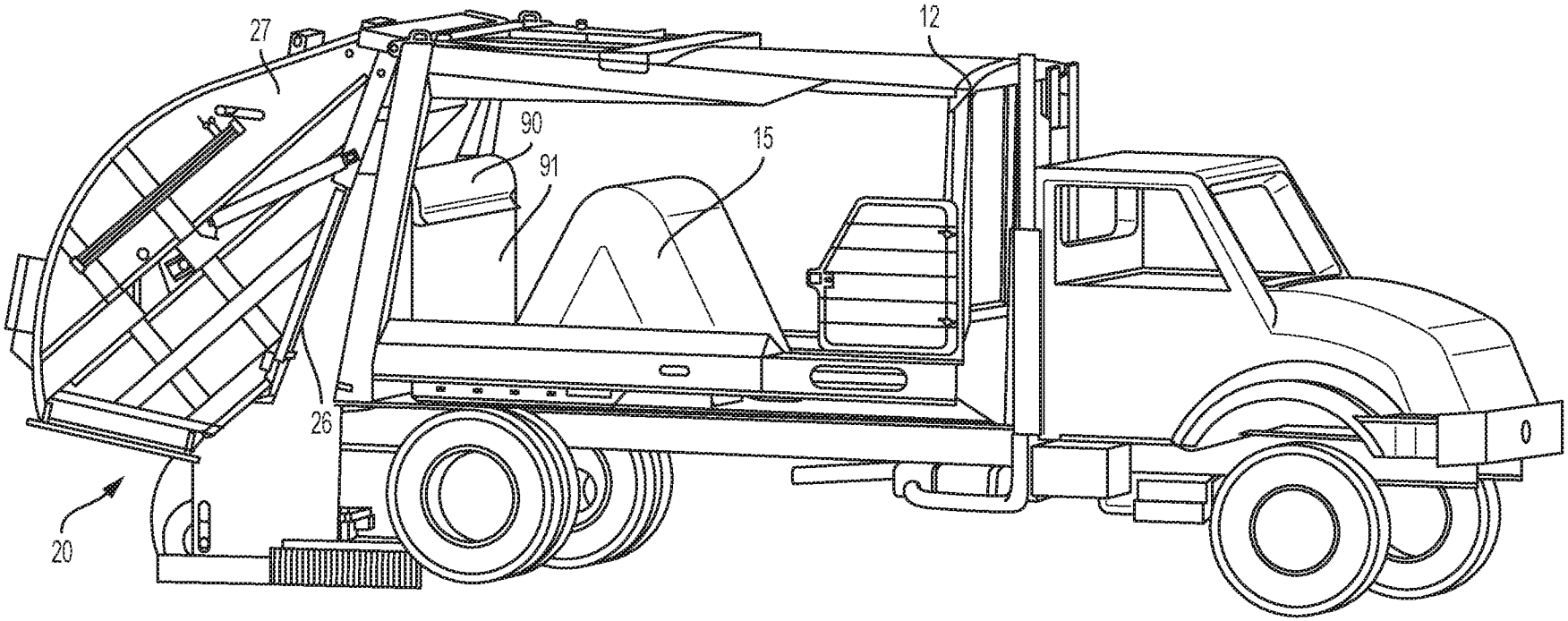
FIG. 4 is a perspective view of the first embodiment of the sweeper attachment on the rear end loader wherein the storage area is shown with a transparent side wall to demonstrate the conveyor system.

A debris pile 15 is shown in FIG. 4 in the collection body 30. The debris pile 15 can be selectively compacted or removed from the rear loader garbage vehicle 22 by known means, including use of ejector panel 12. This first embodiment could also employ dust control systems and methods to aid in collection of street debris (i.e. water spray) as well as other methods to transport street debris into the collection body 30, such as a pneumatic blower mechanism or a vacuum mechanism to transport street debris from the street level to within the collection body 30.

Figure 6:
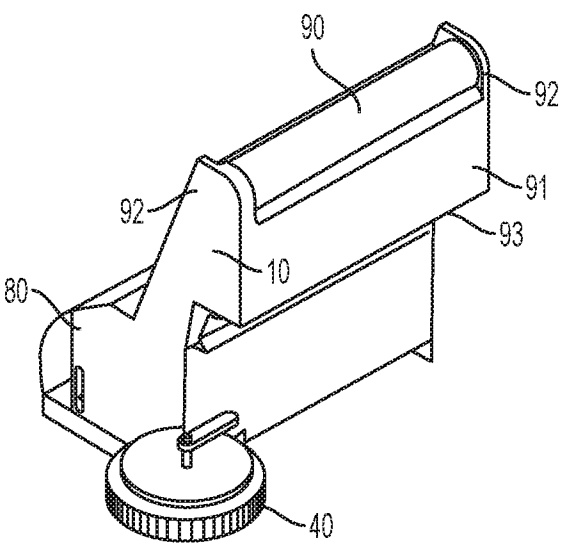
FIGS. 5 and 6 are perspective views of the first embodiment of the sweeper attachment for a rear loader.
Figure 5:
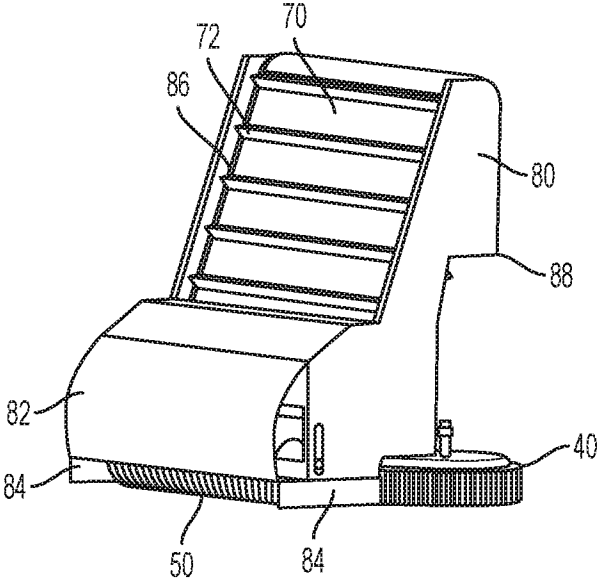
Figure 7:
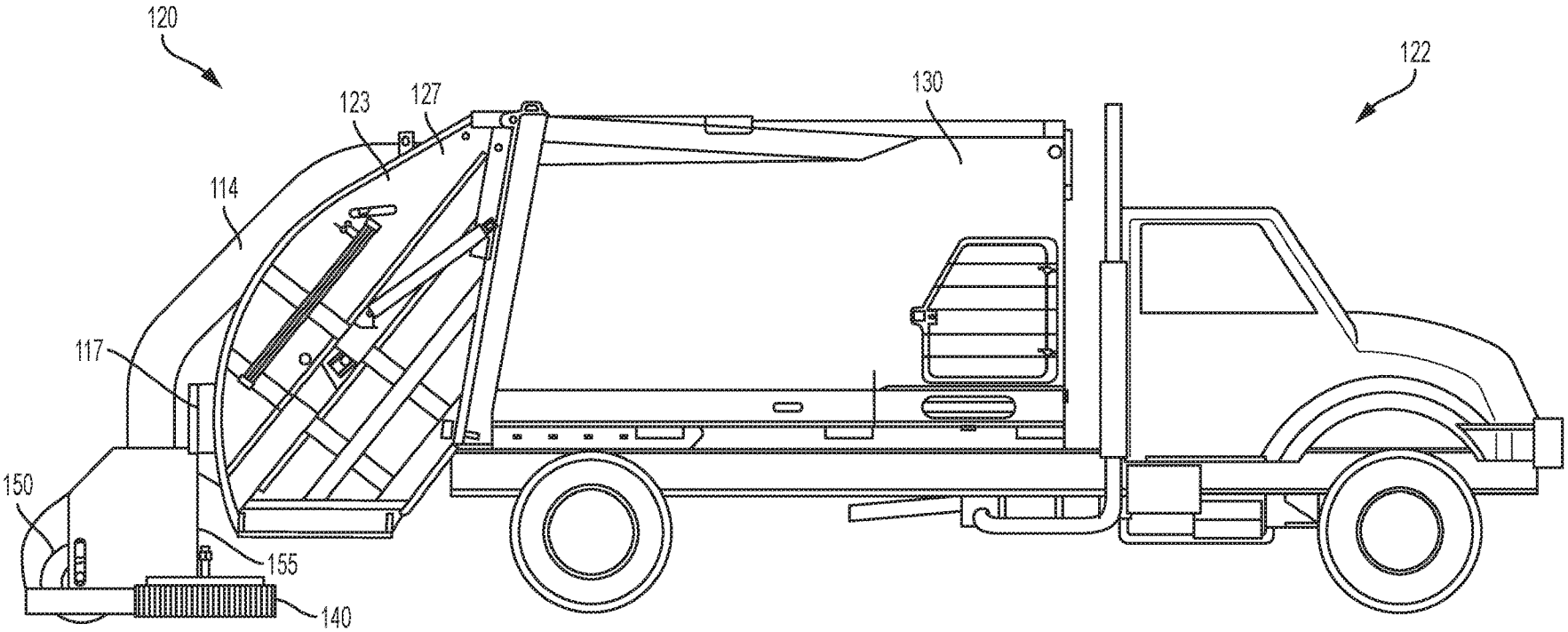
FIG. 7 is a side view of a second embodiment of the sweeper attachment with a vacuum system to move debris from a street to the storage area of the rear end loader.

FIG. 5 shows the first embodiment of the sweeper attachment 20 with all the outside covers removed in order to show the side broom 40, the main broom 50, conveyor 70 and a street sweeper main body 80. In FIG. 6, the sweeper attachment 20 shows the vehicle body insert 91 with sides 92 and bottom 93 designed to fit snugly within sidewalls 96 and floor 97 of the collection body 30, respectively within the back of the collection body 3 so materials will be captured between the insert 91 and the ejector panel 12.

The second embodiment of the sweeper attachment 120 is shown in FIGS. 7-10 and can be used on any standard rear loader garbage vehicle 122. In this embodiment, a sweeper attachment 120 is secured to an outside 123 of a tailgate 127 so that the sweeper attachment 120 can be opened and closed with the normal operation of the tailgate 127 of the rear loader garbage vehicle 122 to allow for the loading and normal unloading of debris commodity 115. A mounting member 117 can be used to mount the sweeper attachment 120 to the tailgate 127. If required, the tailgate 127 can be sealed by an insert (i.e. solid panel) attached to the inside surface of the tailgate 127 to prevent debris dust or leaks between the tailgate 127 and a collection body 130.

During normal operation of the sweeper attachment 120 with the rear loader garbage vehicle 122, a forward positioned side broom 140 rotates, preferably counterclockwise, sweeping the street debris away from the curb towards a main broom 150 of the sweeper attachment 120. This debris along with all other street debris that is in the path of the counterclockwise rotating main broom 150 is then transported pneumatically or by a vacuum 155 up through collection tube 114 into a collection body 130. This embodiment could also employ dust control systems and methods to aid in collection of street debris (i.e. water spray) as well as other methods to transport street debris into the collection body, such as a conveyor system.

Figure 8:
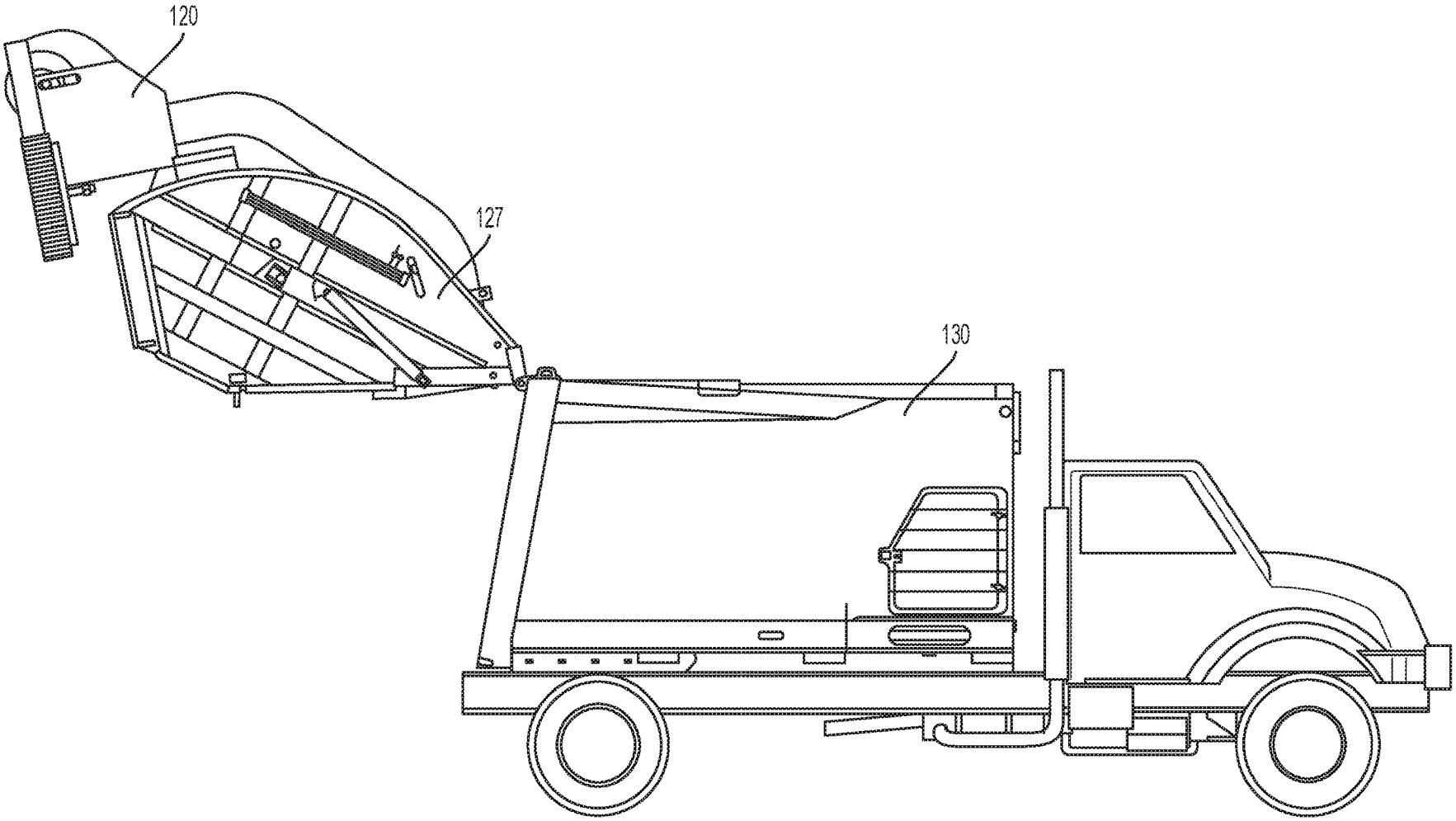
FIG. 8 is a side view of the second embodiment of the sweeper attachment with the vacuum wherein the tailgate is in an open position.

FIG. 8 shows the tailgate 127 in an open position lifting the sweeper attachment 120 out of the way so collected debris can be normally ejected and unloaded out of the rear of the body 130 of the rear loader garbage vehicle 122.

Figure 10:
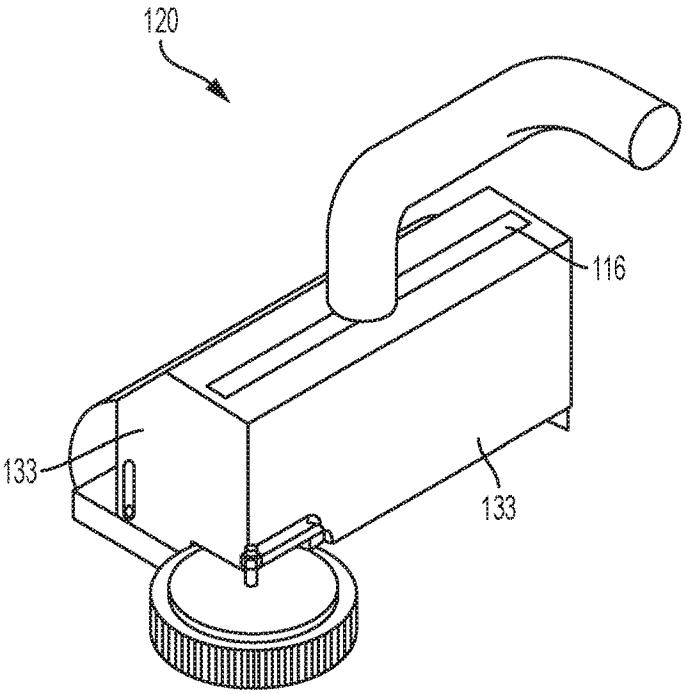
FIGS. 9 and 10 are perspective views of the second embodiment of the sweeper attachment with the vacuum wherein the sweeper attachment is detached from the rear end loader.
Figure 9:
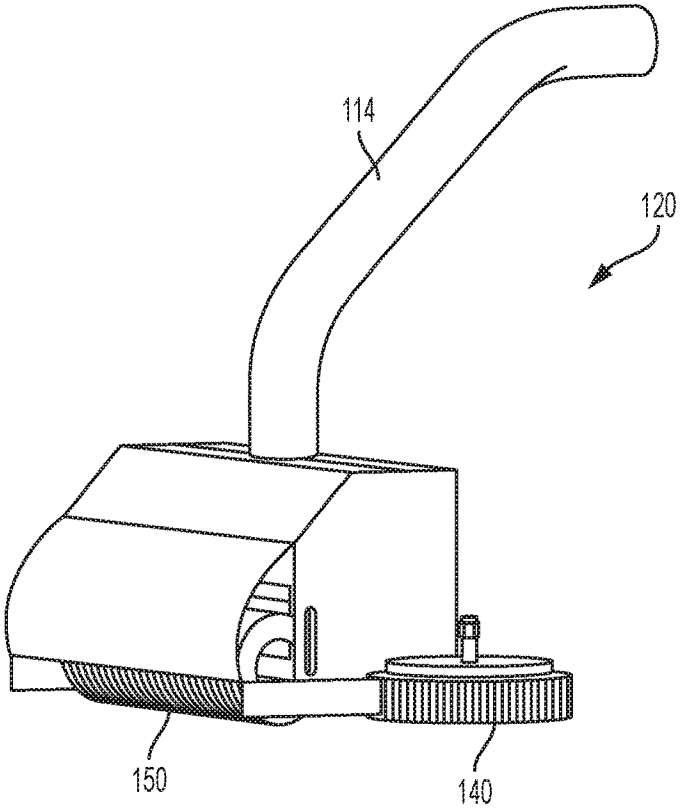

FIGS. 9 and 10 show the sweeper attachment 120 (with all the outside covers off) detailing the side broom 140, the main broom 150, the collection tube 114 and a street sweeper body 133. The collection tube 114 can be mounted in slot 116 and can be movable in slot 116 to accommodate easier connection to the rear loader garbage vehicle 122.

Figure 11:
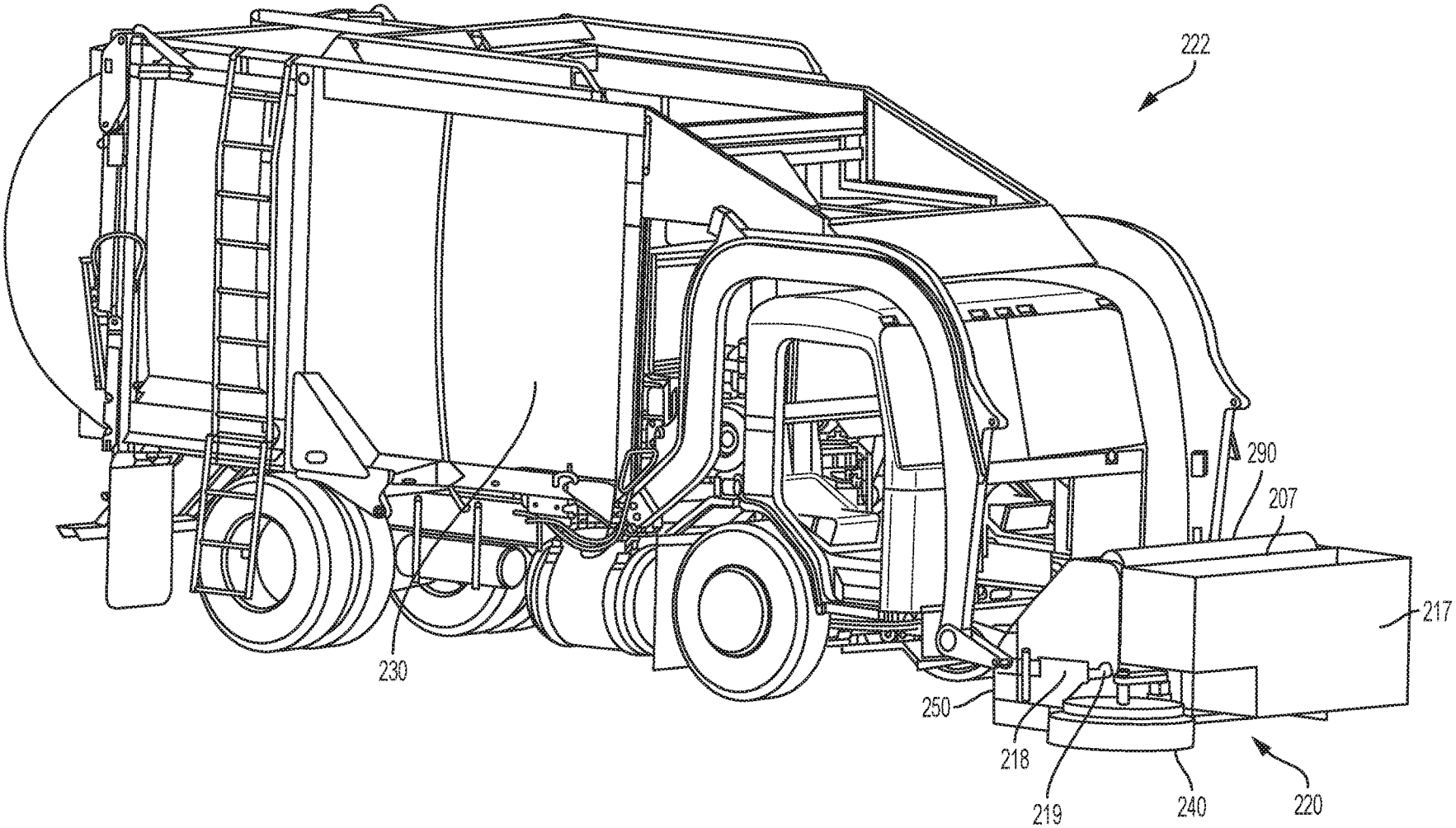
FIG. 11 is a perspective view of a third embodiment of a sweeper attachment for a front end loader.
Figure 12:
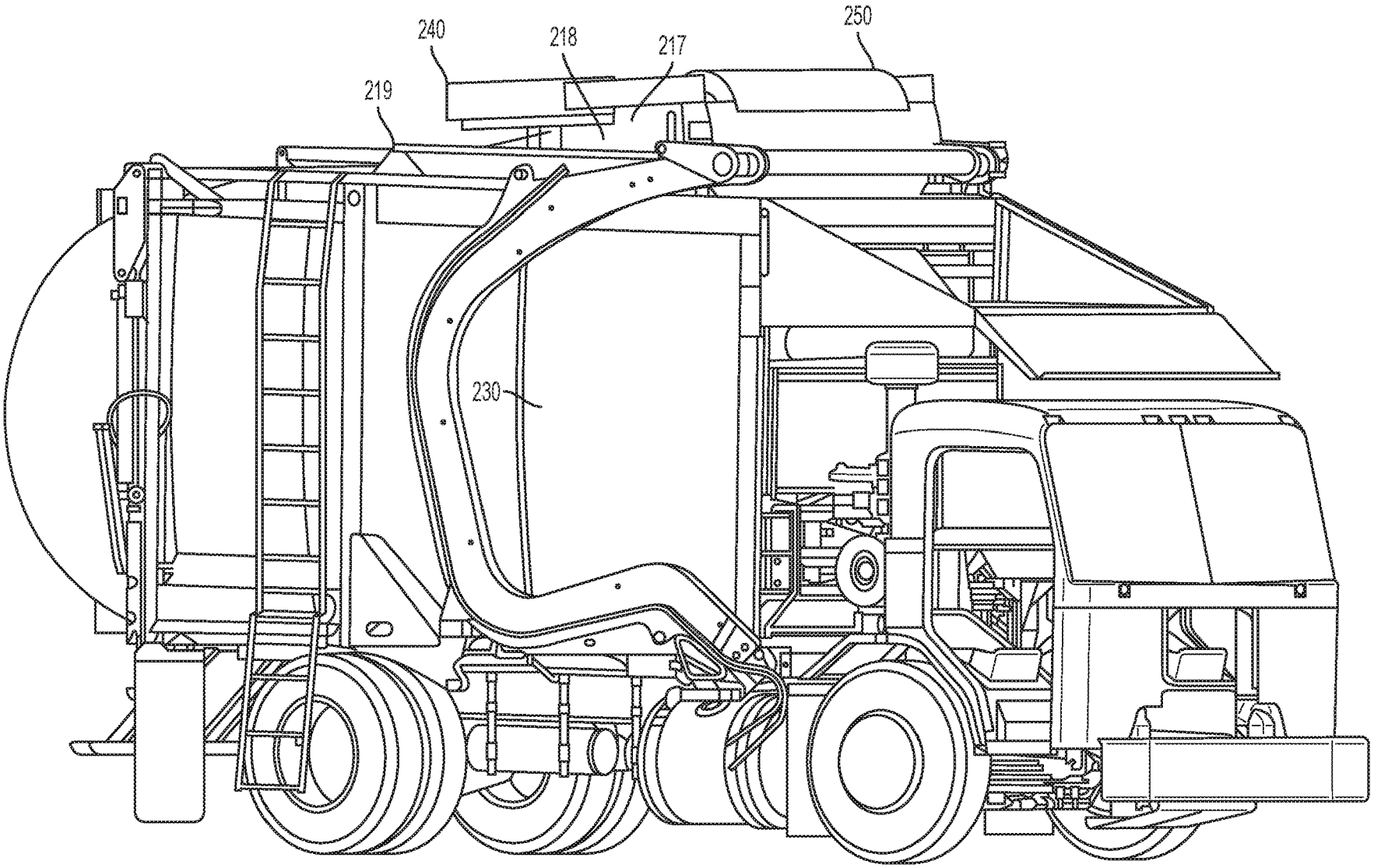
FIG. 12 is a perspective view of the third embodiment of the sweeper attachment for a front end loader wherein the sweeper attachment is in a raised position.

The third embodiment of a sweeper attachment 220 is shown in FIGS. 11-12 and can be used with any standard front loader garbage vehicle 222 that employs forks to collect front loader commercial containers. In this embodiment, the street sweeper attachment 220 has a carry can 217. Fork pockets 218, located on each side of the street sweeper carry can 217, so that forks 219 of the front loader garbage vehicle 222 can slide into the fork pockets 218 to lift the carry can 217 as needed for normal street sweeping operation and for the occasional unloading of street debris into the vehicle collection hopper 230. The carry can 217 can also be configured to employ dust control systems and methods to aid in collection of street debris (i.e. water spray) and/or use pneumatic or vacuum mechanisms to collect street debris.

FIG. 11 shows the carry can 217 in the operational or collection position with the forward positioned side broom 240 rotating, preferably counterclockwise, sweeping the street debris away from the curb towards the main broom 250. This debris along with all other street debris that is in the path of the counterclockwise rotating main broom 250 is mechanically swept up onto the conveyor 207, elevating the debris up and over a top 290 of the conveyor wall into the collection carry can 217. This conveyor process is similar to the one describe in the first embodiment and utilizes delectors and cleats similarly to the first embodiment.

FIG. 12 shows the street sweeper carry can 217 in the unloading position during normal operation, and also the stowed transport position in the vehicle collection hopper 230.

Figure 13:
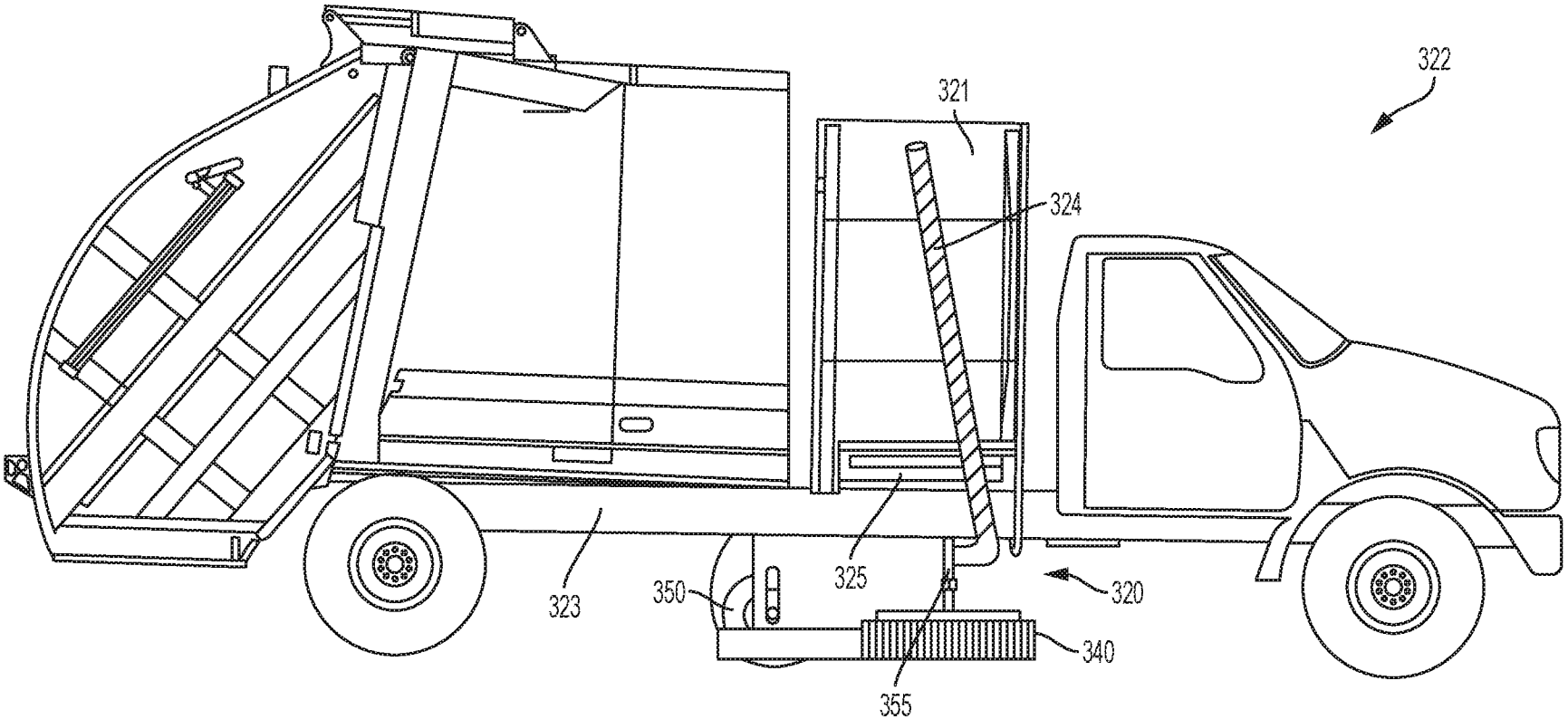
FIG. 13 is a side view of a fourth embodiment of a sweeper attachment for a rear end loader wherein the sweeper attachment is located between the front and rear axles.
Figure 14:
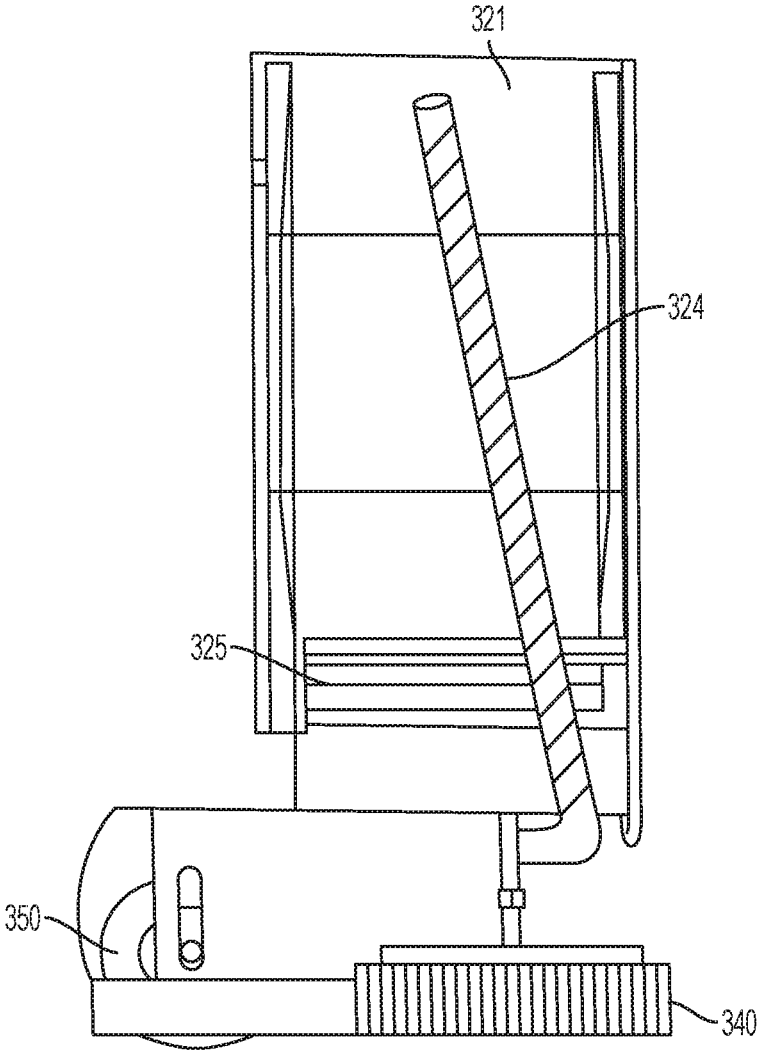
FIG. 14 is a side view of the fourth embodiment of the sweeper attachment.
Figure 15:
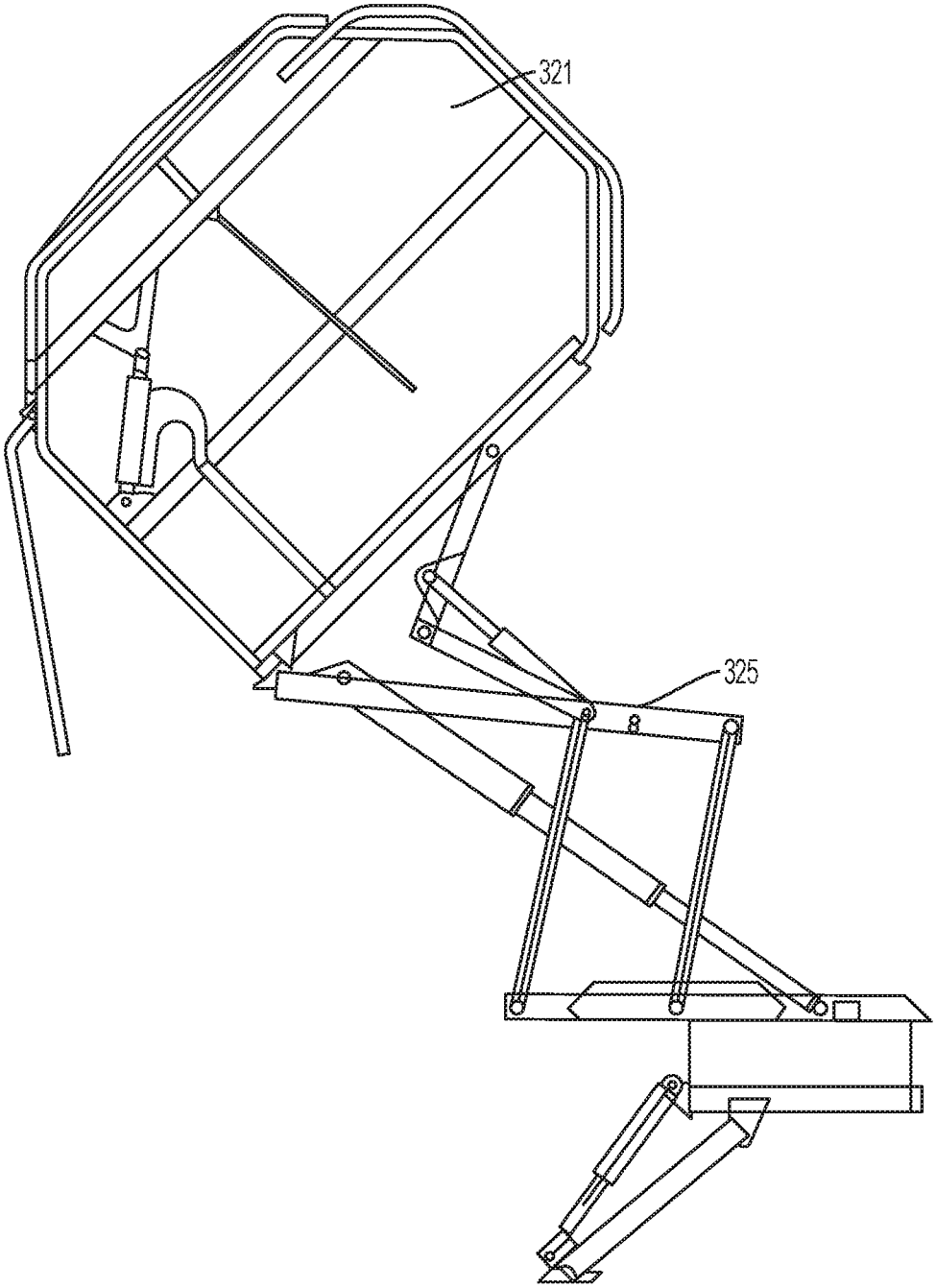
FIG. 15 is a side view of the fourth embodiment of the sweeper attachment as part of a sweeper kit.

Now referring to FIGS. 13-15, a fourth embodiment of a street sweeper attachment 320 for a garbage vehicle is shown that utilizes a separate autonomous independent container, similar to a side dump and/or trough loader container, but designed so it can incorporate a vacuum system to use with a vacuum style street sweeper system. A complete sweeper system can be sold and mounted as a complete kitted system that that can be mounted on a chassis in front of any rear load or side loader body. This system can operate simultaneously during garbage collection so the streets can be cleaned and garbage can be collected at the same time.

This fourth embodiment of a street sweeper attachment 320 can be mounted in front of any standard rear or side loader garbage vehicle and can be used in conjunction with the garbage collection operation. FIG. 13 shows the sweeper attachment 320 on a rear end loader garbage vehicle 322. In this embodiment, a street sweeper attachment 320 is located below a chassis frame 323 and in proximity to a vacuum collection container 321 that is mounted above the vehicle chassis frame 323. The street sweeper attachment 320 is attached to the vacuum collection container 321 by a flexible collection tube 324 so the collected street debris can be transported from the street into the vacuum collection container 321 by use of vacuum 355.

Once the operator has completed the street cleaning or garbage route, the vacuum collection container 321 can be emptied by using a side dump unloading mechanism 325. The side dump unloading mechanism 325 employs a hydraulic powered scissor hoist (shown in FIG. 15) to pivot and unload at the chassis frame level or lift to an elevation to dump collected debris from the vacuum collection container 321 into a roll-off style container of the rear end loader garbage vehicle 322. The garbage vehicle unloads its contents as is normal for the unit without any interference or hindrance from the sweeper attachment kit.

FIG. 13 shows the street sweeper attachment 320 in the operational or collection position with a forward positioned side broom 340 rotating, preferably counterclockwise, sweeping the street debris away from the curb towards a main broom 350. This debris along with all other street debris that is in the path of the counterclockwise rotating main broom 350 of the sweeper, forcing the street debris to become entrained in the air vacuum 355, lifting the street debris up the flexible collection tube 324 and depositing it into the vacuum collection container 321.

FIG. 15 shows the side dump unloading mechanism 325 elevating the vacuum collection container 321 to an elevated unloading position.

This fourth embodiment is particularly useful in locations that require the residents to have a schedule to move cars to one side of the street or the other in order to allow the street sweeping operation or they are fined, towed or both.

Having thus described the invention in connection with the several embodiments thereof, it will be evident to those skilled in the art that various revisions can be made to the several embodiments described herein without departing from the spirit and scope of the invention. It is my intention, however, that all such revisions and modifications that are evident to those skilled in the art will be included with in the scope of the following claims. Any elements of any embodiments disclosed herein can be used in combination with any elements of other embodiments disclosed herein in any manner to create different embodiments.

What is claimed is:

1. A sweeper attachment for sweeping debris from a street surface for a rear loading refuse collection vehicle, wherein the rear loading refuse collection vehicle has a movable tailgate, the sweeper attachment comprising:
- a main body;
- a side broom;
- the side broom rotatable;
- a conveyor;
- a main broom;
- the main broom rotatable;
- the main broom attached to the main body;
- the side broom attached to the main body;
- the side broom in communication with an interior of the main body;
- the main body having a back wall;
- the back wall having an opening;
- the side broom entering a portion of the opening;
- the side broom configured to sweep debris toward the main broom;
- the sweeper attachment movable with the movable tailgate;
- wherein the sweeper attachment and the movable tailgate move in the same direction;
- wherein the side broom and the main broom sweep debris from the street surface into a body of the refuse collection vehicle.

2. The sweeper attachment of claim 1, wherein:
- the main body comprises a first deflector.

3. The sweeper attachment of claim 2, wherein:
- the main body comprises a second deflector wherein the first deflector and the second deflector deflect the debris toward the conveyor.

4. The sweeper attachment of claim 3, wherein:
- the conveyor comprises a plurality of cleats.

5. The sweeper attachment of claim 4, wherein:
- the main body comprises a wall insert wherein the wall insert corresponds to a shape and a width of a sidewall of the collection vehicle.

6. The sweeper attachment of claim 5, wherein:
- the wall insert comprises a bottom wherein the bottom corresponds to a shape and width of a floor of the collection vehicle.

7. The sweeper attachment of claim 6, wherein:
- the main broom has a longitudinal axis defined by the length of the main broom;
- the main broom rotates around the longitudinal axis.

8. The sweeper attachment of claim 7, wherein:
- the side broom rotates perpendicular to the rotation of the main broom.

9. The sweeper attachment of claim 8, wherein:
- the main body has a second side;
- wherein the second side has a shape that corresponds to the shape of a tailgate of the collection vehicle.

10. A sweeper attachment for a rear loading refuse collection vehicle, wherein the rear loading refuse collection vehicle has a movable tailgate, the sweeper attachment comprising:
- a main body;
- a side broom;
- the side broom rotatable;
- a vacuum;
- a main broom;
- the main broom attached to the main body;
- the side broom attached to the main body;
- the sweeper attachment movable with the movable tailgate;
- wherein the sweeper attachment and the movable tailgate move in the same direction;
- the side broom in communication with an interior of the main body;
- the main body having a back wall;
- the back wall having an opening;
- the side broom entering a portion of the opening;
- the side broom configured to sweep debris toward the main broom;
- wherein the side broom and the main broom sweep debris from a road into a flow of air generated by the vacuum toward a body of the collection vehicle.

11. The sweeper attachment of claim 10, wherein:
- the main body comprises a first deflector.

12. The sweeper attachment of claim 11, wherein:
- the main body comprises a second deflector wherein the first deflector and the second deflector deflect the debris toward a collection tube.

13. The sweeper attachment of claim 12, wherein:
- the main body comprises a mounting member wherein the mounting member is selectively attachable to a tailgate of the collection vehicle.

14. The sweeper attachment of claim 13, wherein:
- the collection tube is positioned in a slot of the main body.

15. The sweeper attachment of claim 14, wherein:
- the main broom has a longitudinal axis defined by the length of the main broom;
- the main broom rotates around the longitudinal axis.

16. The sweeper attachment of claim 15, wherein:
- the side broom rotates perpendicular to the rotation of the main broom.

* * * * *